US005579998A

United States Patent [19]

Hall et al.

[11] Patent Number: 5,579,998

[45] Date of Patent: Dec. 3, 1996

[54] METHOD FOR COATING A SUBSTRATE WITH A REINFORCED RESIN MATRIX

[75] Inventors: Terry L. Hall; Jack G. Scarpa, both of Huntsville; David D. Mathias, Athens, all of Ala.

[73] Assignee: USBI Co., Huntsville, Ala.

[21] Appl. No.: 310,900

[22] Filed: Sep. 22, 1994

Related U.S. Application Data

[60] Continuation of Ser. No. 190,400, Feb. 2, 1994, abandoned, which is a division of Ser. No. 978,000, Nov. 18, 1992, Pat. No. 5,307,992.

[51] Int. Cl.[6] ..... B05B 7/14; B05B 7/16

[52] U.S. Cl. ..... 239/9; 239/13; 427/422; 427/426

[58] Field of Search ..... 239/8, 9, 11, 13, 239/135, 296, 300, 418, 419.3, 422, 423, 424, 424.5, DIG. 8; 427/421, 422, 426

[56] References Cited

U.S. PATENT DOCUMENTS

| | | | |
|---|---|---|---|
| 1,219,642 | 3/1917 | Isaacs | 239/300 |
| 2,646,314 | 7/1953 | Peeps . | |
| 2,862,545 | 12/1958 | Snow et al. | 239/422 |
| 2,971,700 | 2/1961 | Peeps | 239/296 |
| 3,107,057 | 10/1963 | Hanusch | 239/336 |
| 3,185,396 | 5/1965 | Black | 239/424 X |
| 3,214,103 | 10/1965 | Kempthrone | 239/422 |
| 3,232,540 | 2/1966 | Cassanmagnago | 239/416 |
| 3,292,859 | 12/1966 | Landon | 239/9 |
| 3,484,044 | 12/1969 | Dombruch et al. | 239/8 |
| 3,504,861 | 4/1970 | Peeps et al. | 239/300 |
| 3,535,151 | 10/1970 | Raffel et al. | 239/DIG. 8 X |
| 4,187,983 | 2/1980 | Boyer | 239/9 |
| 4,263,346 | 4/1981 | Sandell | 239/424 X |
| 4,547,403 | 10/1985 | Smith | 239/424.5 X |
| 4,673,594 | 6/1987 | Smith | 427/426 X |
| 4,681,258 | 7/1987 | Jenkins et al. | 239/66 |
| 4,809,909 | 3/1989 | Kukesh | 239/DIG. 8 X |
| 4,814,201 | 3/1989 | Smith | 427/426 X |
| 4,821,963 | 4/1989 | Arnout et al. | 239/419 |
| 4,844,347 | 7/1989 | Konhäuser et al. | 239/300 X |
| 4,854,504 | 8/1989 | Hedger, Jr. et al. | 239/294 |
| 4,923,121 | 5/1990 | Boyer | 239/9 X |
| 4,961,536 | 10/1990 | Conreard | 239/300 X |
| 4,967,956 | 11/1990 | Mansfield | 239/DIG. 8 X |
| 5,190,217 | 3/1993 | Black et al. | 239/DIG. 8 X |

FOREIGN PATENT DOCUMENTS

| | | | |
|---|---|---|---|
| 1248406 | 10/1971 | United Kingdom | 239/424.5 |

*Primary Examiner*—Lesley D. Morris

*Attorney, Agent, or Firm*—Pamela J. Curbelo; Dominic J. Chiantera

[57] ABSTRACT

Coating a substrate with a reinforced resin matrix comprised of liquid resin and reinforcing material can be accomplished with an apparatus where the liquid resin and the reinforcing material are mixed external to the apparatus prior to impacting the substrate. The liquid resin is directed through a cylinder 12 and then through an orifice 7 in nozzle 1, while the reinforcing material is carried in a gas stream through cavity 13, around cylinder 12, and past the nozzle 1. As the reinforcing material passes the nozzle 1, it is drawn into the liquid resin. Due to the distribution of the reinforcing material around the liquid resin flow, the reinforcing material is substantially homogeneously wetted by the liquid resin prior to impacting the substrate.

6 Claims, 1 Drawing Sheet

METHOD FOR COATING A SUBSTRATE WITH A REINFORCED RESIN MATRIX

This is a continuation of application Ser. No. 08/190,400 filed on Feb. 2, 1994, now abandoned, which is a division of application Ser. No. 07/978,000 failed on Nov. 18, 1992, now U.S. Pat. No. 5,307,992.

TECHNICAL FIELD

The present invention relates to a method and system for coating a substrate, and especially relates to a method and system for coating a substrate with a liquid resin containing a reinforcing material.

BACKGROUND OF THE INVENTION

Coating substrates with reinforced resin matrices, such as liquid resins reinforced with fibers, glass microspheres, or other reinforcing materials, conventionally requires mixing the liquid resin with the reinforcing material and then painting or spraying the mixture onto the substrate, or dipping the substrate into the mixture. When only a portion of the substrate requires coating, accuracy and control requirements typically dictate the use of a spray coating process. Spray coating processes, however, are limited due to the low sprayability of the liquid resins which are typically highly viscous, the limit in attainable coating thickness, and the high amount of waste material generated.

Many liquid resins utilized in spray coating processes possess viscosities of about 20,000 centipoise (cps) or greater. At such high viscosities, pumping the liquid resin through the lines and nozzle of a spray coating apparatus is difficult and requires large amounts of energy. In order to reduce energy requirements and to simplify the spray coating process, the viscosity of the liquid resin is often reduced to about 2,000 cps by mixing the liquid resin with a solvent. Typically, however, solvents useful in spray coating processes are generally environmentally hazardous. Consequently, waste material from the spray coating process must be disposed of as hazardous waste.

Conventional spray coating processes comprise combining a liquid resin, solvents, reinforcing material, and other conventional constituents such as curing agents, biocides, etc., in a vat to form a mixture. This mixture is then pumped from the vat through lines to a nozzle where it is atomized and sprayed onto the substrate. Once the mixture has been applied to the substrate, the solvent is removed therefrom by the natural evolution of volatile gas and/or by applying heat to the mixture to hasten the solvent evolution.

During the solvent evolution, solvent near the substrate surface migrates to the coating surface, dragging liquid resin with it, and thereby forming resin starved areas in the coating. These resin starved areas result in poor adhesion between the coating and the substrate, and act as potential coating failure points. The effect of the solvent migration can be minimized by applying thinner coatings, less than about 0.04 inches, to the substrate. However, thick coatings of about 0.25 to about 0.50 inch or greater, are often required to attain the desired substrate protection, such as thermal protection.

An additional disadvantage of these coating processes is system clogging. Since all of the coating constituents are combined in a vat, they all must be pumped thorough the coating system as a single mixture. During the pumping, the liquid resin can begin to set up within the system, resulting in a clogged nozzle and/or lines. Furthermore, the reinforcement can accumulate within the lines or the nozzle, also causing clogging thereof.

What is needed in the art is an improved spray coating apparatus and process which reduces waste and system clogging while improving the structural integrity of thicker coatings.

DISCLOSURE OF THE INVENTION

The present invention relates to an apparatus for applying a coating of a reinforced resin matrix to a substrate. This apparatus is comprised of a spray nozzle for directing liquid resin toward the substrate. This nozzle has an orifice located substantially in the center of the nozzle, a plurality of atomizing holes circumferentially disposed around the orifice, and a plurality of shaping holes circumferentially disposed around the orifice at a greater distance from said orifice than the atomizing holes. This nozzle is connected to a first end of a means for introducing the liquid resin to the nozzle. The means for introducing the liquid resin has a first end, a second end, and an axis which intersects the first and second ends. An outer housing is located coaxial with and circumferentially disposed around the means for introducing the liquid resin so as to form a cavity therebetween. This housing has an open end and a closed end, with the open end of the outer housing located near the first end of the means for introducing said liquid resin.

The present invention further relates to a method for coating a substrate with a reinforced resin matrix. This method comprises introducing a liquid resin to the means for introducing said liquid resin, passing said liquid resin through the orifice, atomizing the liquid resin, and shaping the liquid resin. A reinforcing material is introduced to the cavity and substantially uniformly distributed around said means for introducing said liquid resin. The reinforcing material is carried on a gaseous stream through said cavity and past said nozzle, where it is drawn into the liquid resin to form a combined flow. The substrate is contacted with the combined flow.

The present invention also relates to a nozzle. This nozzle has an orifice located substantially in the center of the nozzle, a plurality of atomizing holes circumferentially disposed around the orifice, and a plurality of shaping holes circumferentially disposed around the orifice at a greater distance from said orifice than the atomizing holes. This nozzle also has a first gas line and a second gas line, with the first gas line attached to the atomizing holes and the second gas line attached to the shaping holes such that different pressure gas can be passed through the atomizing holes and the shaping holes.

The foregoing and other features and advantages of the present invention will become more apparent from the following description and accompanying drawings.

Figure 1:
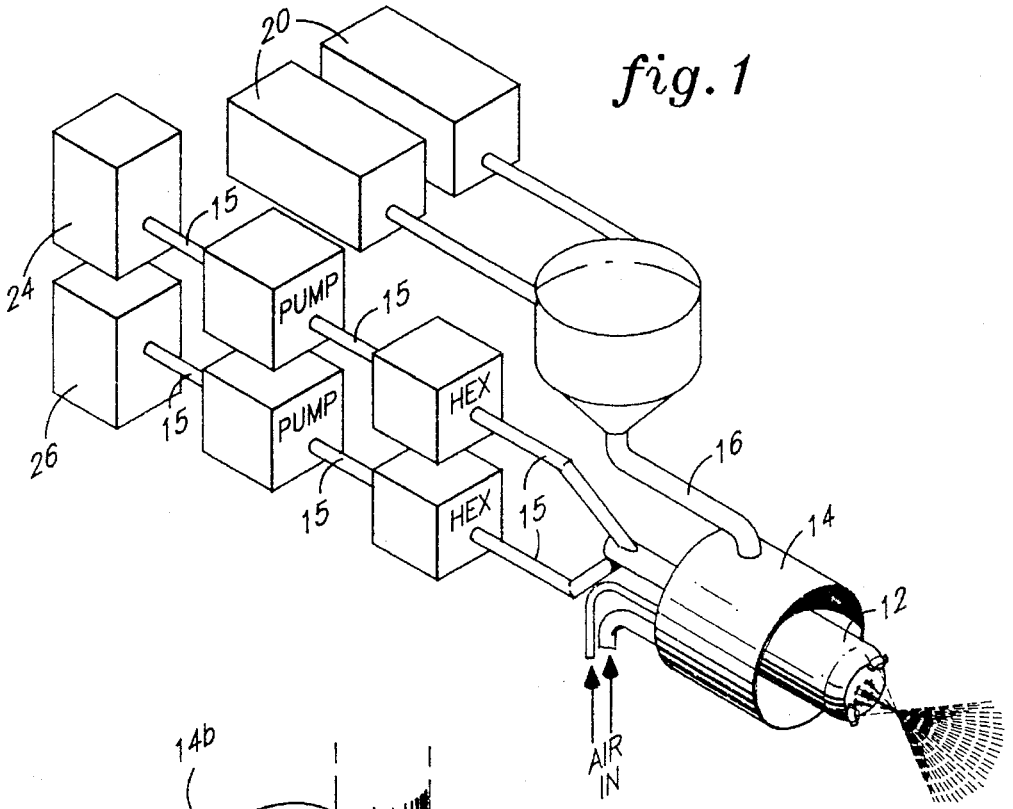
FIG. 1 is one embodiment of the spray coating system of the present invention.
Figure 2:
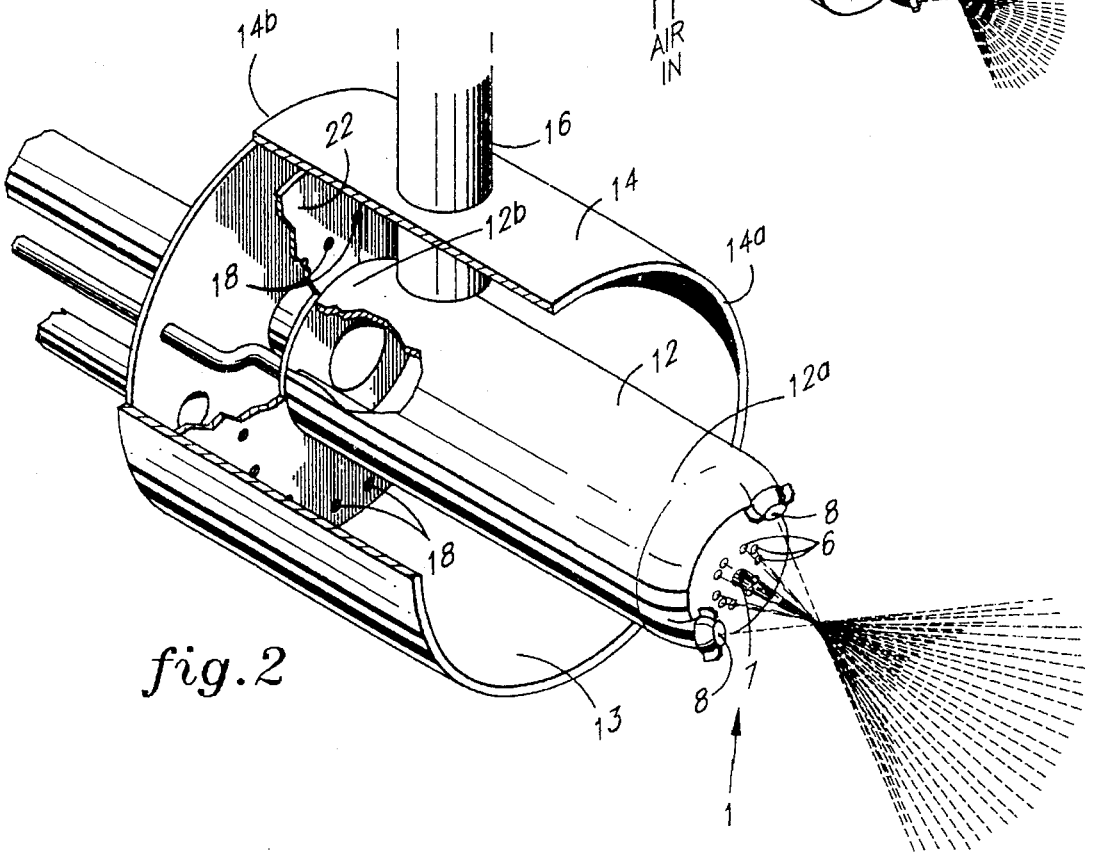
FIG. 2 is a cut-away view of one embodiment of the spray coating apparatus of the present invention.

These figures are meant to further clarify and illustrate the present invention and are not intended to limit the scope thereof.

BEST MOST FOR CARRYING OUT THE INVENTION

The present invention is directed toward improving spray coating processes by decreasing waste and system problems such as clogging. The amount of waste material produced is decreased by mixing the liquid resin with other liquid resins and/or other conventional constituents immediately prior to the spray nozzle and by reducing the viscosity of the liquid resin with heat instead of environmentally hazardous solvents. Mixing immediately prior to the nozzle decreases the amount of equipment and lines which must be filled with the resinous mixture during the spraying process. Additionally, this decrease in the line length which the resinous mixture must travel, decreases the potential for the liquid resin to set up in the lines or equipment which causes clogging. Meanwhile, utilizing heat as a means for reducing the viscosity of the liquid resin eliminates the need to mix a solvent with the liquid resin in a vat, and allows the liquid resin to readily be pumped through the spray coating apparatus and mixed with the constituents immediately prior to the nozzle. Consequently, the spray coating process of the present invention typically produces less that about a tenth of the waste material produced by conventional spray coating processes.

The system clogging problem is further addressed by mixing the liquid resin with a reinforcing material at a point external to the spray coating apparatus. Both the liquid resin and the reinforcing material are directed toward the substrate in a parallel course with the reinforcing material circumferentially disposed around the liquid resin flow. Once the liquid resin exits the nozzle in the spray coating apparatus, the reinforcing material is drawn into the liquid resin. This apparatus configuration and method eliminates clogging problems caused by the reinforcing material.

An apparatus capable of accomplishing the above described improvements comprises an outer housing circumferentially disposed around and coaxial with a cylinder such that a cavity is formed between the cylinder and the outer housing, with a nozzle having a liquid orifice, atomizing holes, and shaping holes, connected to one end of the cylinder. The cylinder 12 which functions as a means for introducing the liquid resin to the nozzle 1, can be any conventional means capable of directing the liquid resin to the nozzle 1 having a first end 12*a* and a second end 12*b*, with the first end 12*a* connected to the nozzle 1, such as a conduit, a pipe, or another conventional means. Similarly, the nozzle can be conventional, such as spray nozzles produced by Binks, Franklin Park, Ill., and Graco, Detroit, Mich., among others, having an orifice 7 for moving the liquid resin out of the cylinder 12, a plurality of atomizing holes 6 for atomizing the liquid resin once it passes out of the orifice 7, and shaping holes 8 for controlling the spray area of the liquid resin by forming it into a fan shape of the desired spray width.

The orifice 7 is typically located substantially in the center of the nozzle 1. This orifice 7 can be a single hole or a plurality of holes for directing the liquid resin from the nozzle 1 toward the substrate and it can have any geometry and a size which supports the desired liquid resin flow rate. Typically, this orifice 7 is about 0.020 inches to about 0.5 inches in diameter, with about 0.100 inches to about 0.2 inches preferred for most liquid resins having viscosities of about 1,000 cps to about 5,000 cps.

The atomizing holes 6 are circumferentially disposed around the orifice 7. The parameters of these atomizing holes 6, which are readily determined by a one skilled in this art, are system dependent based upon the type of liquid resin to be atomized, the pressure required for such atomization, and the desired droplet size of the atomized liquid resin. The smallest, feasibly attainable droplet sizes are preferred to ensure high wetting of the reinforcing material when it is drawn into the liquid resin (discussed below). High wetting of the reinforcing material produces a stable coating having structural integrity and improved texture and surface finish. Decreasing the droplet sizes comprises increasing the gas pressure prior to the atomizing holes 6 or decreasing the diameter of the atomizing holes 6. For instance, in an epoxy coating system utilizing cork reinforcing material, the preferred atomizing hole diameter is about 0.010 inches to about 0.030 inches using a gas pressure of about 15 psig to about 45 psig, with the liquid resin passing through the orifice 7 having a diameter of about 0.030 inches to about 0.100 inches at a pressure of about 50 psig to about 125 psig.

As with the atomizing holes 6, the shaping holes 8 are also circumferentially disposed around the orifice 7, but typically at a greater distance from the orifice 7 than the atomizing holes 6 since atomizing the liquid resin after the liquid resin flow has been shaped may reduce control over the liquid resin flow shape causing liquid resin to be applied to the substrate in undesired areas. These shaping holes 8 control the spray area of the liquid resin flow, typically by forming the flow into a fan shape having an essentially elliptical circumference so that it can be sprayed onto a designated area of the substrate. Depending upon the desired fan width, the type of liquid resin, the size and amount of shaping holes, and the angle between the liquid resin flow axis and the shaping holes, the pressure of the gas entering the shaping holes is adjusted.

Since the portion of the substrate to be coated may not be symmetrical, it is often desirable to adjust the fan width of the liquid resin during the coating process by changing the gas pressure to the shaping holes 8. Increasing the gas pressure to the shaping holes 8 decreases the fan width while decreasing the gas pressure to the shaping holes 8 increases the fan width. Unfortunately, the range of gas pressures to the shaping holes 8 is dependent upon the minimum pressure required to atomize the liquid resin since conventional nozzles utilize common pressure controls for both the atomizing holes 6 and the shaping holes 8. Consequently, continuous atomization of the liquid resin while adjusting the gas pressure to the shaping holes 8 over a broad range of pressures requires maintenance of separate pressure controls for the atomizing holes 6 and the shaping holes 8. Therefore, separate pressure controls and gas supply lines are preferred for the atomizing holes 6 and the shaping holes 8.

Typically, the angle between the shaping holes 8 and the liquid resin flow axis is about 5° to about 85°, with about 20° to about 45° preferred. The pressure of the gas entering shaping holes 8 having an angle of about 20° to about 45° and a diameter of about 0.01 inches and about 0.2 inches, ranges from about 10 psig to about 70 psig. A pressure of about 15 psig to about 30 psig is preferred for holes having a diameter of about 0.03 inches and about 0.15 inches. Different pressures may be preferred for different amounts of shaping holes or for shaping holes having angles greater than about 45° or less than about 20°.

Concurrent with the flowing of the liquid resin through the cylinder 12, the flow of the liquid resin through the orifice 7, the atomization of the liquid resin, and the shaping thereof, the reinforcing material is carried in a gas stream through the cavity 13, around the cylinder 12, and past the nozzle 1 where it is drawn into the liquid resin flow to form a substantially homogenous combined flow. The cavity 13 is formed by an outer housing 14 located coaxial with and circumferentially disposed around the cylinder 12 with an open end 14*a* located near the first end 12*a* of the cylinder 12 and a closed end 14*b* located near the second end 12*b* of the cylinder 12. This cavity 13 functions as a means for confining the reinforcing material flow while a gas stream flowing through the cavity 13 suspends the reinforcing material and carries it through the cavity 13 such that the flow of the reinforcing material is parallel to the cylinder axis and therefore is parallel to the liquid resin flow.

Uneven introduction of the reinforcing material to the liquid resin inhibits complete mixing of the reinforcing material and the liquid resin, thereby decreasing the wetting of the reinforcing material and the structural integrity of the coating. If the reinforcing material merely enters the liquid resin from a few points around the cylinder 12, the resulting coating will contain resin starved areas having non-wetted reinforcing material. These areas provide possible points of failure where the coating will crack and/or de-bond from the substrate. Wetting of the reinforcing material is improved by substantially evenly distributing the reinforcing material around the cylinder 12 which provides a more homogenous entry of the reinforcing material into the liquid resin. Substantially even distribution of the reinforcing material around the cylinder 12 is accomplished via the combination of an air disc 22 for forming the gas stream which carries the reinforcing material and a conduit 16 for introducing the reinforcing material to the cavity 13.

The air disc 22, which forms the closed end of the outer housing 14, has holes 18 for forming a gas stream around the cylinder 12. The size and number of the holes 18 and the flow rate of the gas therethrough is sufficient to suspend the reinforcing material in the gas stream, to carry the reinforcing material toward the substrate such that the flow of the reinforcing material is parallel to the cylinder axis, and to provide substantially uniform introduction of the reinforcing material to the liquid resin flow. These parameters, which are readily determined by one skilled in this art, are directly related to the type of reinforcing material utilized and can vary depending upon the desired pressure of the gas and the desired size of the holes.

For a system utilizing cork and/or glass microspheres as reinforcing material, about 8 to about 32 holes having a diameter of about 0.062 inches to about 0.125 inches and located substantially equidistant apart and substantially equidistant between the cylinder 12 and the outer housing 14, are preferred. Also, utilization of a gas flow pressure of about 25 psig (pounds per square inch gauge) to about 40 psig is preferred with the cork and/or glass microspheres reinforcing material, with a gas pressure of about 28 psig to about 35 psig especially preferred.

The conduit 16 which introduces the reinforcing material to the cavity 13 functions in combination with the air disc 22 and holes 18 in order to ensure that the reinforcing material is evenly distributed around cylinder 12 and substantially evenly carried out of the cavity 13. This conduit 16 is typically oriented perpendicular to the cylinder 12 axis and typically protrudes through the outer housing 14, past holes 18. Locating the conduit 16 in such a fashion prevents the gas passing through holes 18 from prematurely carrying the reinforcing material out of the cavity 13 thereby interferring with the uniform distribution of the reinforcing material around the cylinder 12. The orientation of this conduit 16, however, can be at any angle which allows sufficiently uniform distribution of the reinforcing material around the cylinder 12. When the conduit 16 protrudes past holes 18, it is also preferred to locate at least one of the holes 18 behind the conduit 16 to prevent the formation of an eddy between the conduit 16 and the air disc 22 which can collect reinforcing material and interfere with the uniform distribution of the reinforcing material around the cylinder 12.

The reinforcing material is introduced to the conduit 16 via a conventional means for introducing reinforcing materials 20. Possible means include gravity feeders, cork screw feeders, belt feeders, pressurized feeders, vibratory feeders, and other conventional feeders. One such feeder is a "loss-in-weight" vibratory feeder produced by Schenk, Fairfield, N.J. This feeder is preferred because it is capable of continuously introducing a given amount of reinforcing material to the conduit 16, thereby allowing the introduction of a substantially homogenous amount of reinforcing material to the liquid resin and improving the wetting of the reinforcing material.

To further ensure wetting of substantially all of the reinforcing material by the liquid resin, the flow rate of the reinforcing material can be adjusted. If the flow rate is too great, a larger amount of reinforcing material will be drawn into the liquid resin than the resin is capable of wetting, thereby ensuring a coating with resin starved areas while if the flow rate of the reinforcing material is too slow, an insufficient amount of reinforcing material will be available to reinforce the coating. The preferred flow rate of both the reinforcing material and the liquid resin can readily be determined by one skilled in this art based upon the specific reinforcing material and liquid resin. Typically, the reinforcing material is supplied at a rate of about 50 g/min (grams per minute) to 200 g/min for an epoxy liquid resin/cork coating system. However, this rate can be varied according to the systems and the amount of reinforcing material desired in the coating.

Wetting of the reinforcing material can be further improved by improving the flowability of the liquid resin and therefore the atomization of the liquid resin. As the viscosity of the liquid resin decreases, the mobility of the liquid resin through the coating system improves and the ability to atomize the liquid resin to smaller droplet sizes also improves. Typically, the liquid resin has a high viscosity, about 20,000 cps or greater, while viscosities of about 2,000 cps are preferred, with viscosities of about 900 cps to about 1,500 cps especially preferred for 2216 A & B liquid resin systems.

The liquid resin's viscosity can be adjusted by heating the liquid resin either in the liquid resin supply 24 and 26 (see FIG. 1), in the lines 15 directing the liquid resin to the cylinder 12 or in the cylinder 12 itself. Sufficient heat is applied to the liquid resin to lower the liquid resin's viscosity to about 2,000 cps or lower without prematurely curing or deteriorating the liquid resin, with a viscosity of about 1,000 cps or lower preferred. The appropriate temperature to heat the liquid resin is readily determined by an artisan and is dependent upon the characteristics of the liquid resin itself. For a 2216 A & B liquid resin system, an epoxy resin and accelerator produced by 3M Corp. St. Paul, Minn., it is preferred to heat the epoxy resin and accelerator to about 110° F. to about 145° F. in order to decrease its viscosity from about 20,000 cps to about 1,000 cps, thereby obtaining flow rates which promote atomization of the liquid resin. Temperatures higher than this tend to cure the epoxy resin prematurely and clog the spray coating apparatus while lower temperatures fail to sufficiently lower the epoxy resin viscosity.

Once the reinforcing material has been drawn into the liquid resin and wetted, the combined flow then contacts the substrate. The distance between the nozzle 1 and the substrate, commonly known as the stand-off distance, is determined by the trajectory of the combined flow. It is preferred that the stand-off distance correspond to that distance which is less than the distance at which the trajectory of the combined flow would arc downward due to the pull of gravity. Typically, the stand-off distance ranges from about 5 inches to about 30 inches, with about 8 inches to about 15 inches preferred for most cork/glass/epoxy liquid resin coatings. The coated substrate is then cured in a conventional manner to form the coated article.

Where a plurality of liquid resins are desired or if any conventional constituents such as curing agents, biocides, etc., are employed, a mixing means can be utilized. This mixing means resides in the cylinder 12 prior to the nozzle 1 such that the liquid resins, curing agents, biocides, and other constituents are mixed immediately prior to entering the nozzle 1 to form a resinous mixture. Locating this mixer adjacent to the nozzle 1 eliminates the requirement for long lines between the mixer and the nozzle 1. The reduction in the distance which the resinous mixture must travel reduces the length of time between the mixing of the liquid resin and the spraying of the resinous mixture onto the substrate, thereby reducing the possibility of line or equipment clogging. Additionally, reducing the travel distance further reduces the amount of excess resinous mixture in the lines once the coating process is complete, thereby decreasing the amount of waste material. Possible mixing means include conventional mixers such as static mixers, dynamic mixers, and other conventional means. Dynamic mixers are preferred since they require minimal length.

During operation of the spray coating apparatus, the liquid resin passes through the cylinder 12 and out of the orifice 7 in nozzle 1 while the reinforcing material is simultaneously carried in an gas stream through cavity 13 and past the nozzle 1. Once the liquid resin flows out of the orifice 7, it is atomized by gas passing through atomizing holes 6 and is molded into a fan shape by shaping holes 8 while the reinforcing material is drawn into the liquid resin. The combined flow then contacts the substrate.

Consequently, coating a substrate with a four part coating having two reinforcing materials and two liquid resins with high viscosity will trace the following sequence. Two liquid resins, A and B, are heated to reduce their viscosity to about 1,000 cps and are separately transported from the liquid resin supplies 24 and 26, respectively, to the cylinder 12 through the second end **12*b* where they are mixed in a conventional fashion to form a resinous mixture. This resinous mixture is introduced to the nozzle 1 where it passes through the orifice 7 and is atomized into fine droplets about 75 microns to about 100 microns in diameter by gas passing through ten atomizing holes 6**.

Meanwhile, the two reinforcing materials pass through the conduit 16 into cavity 13 and are suspended and carried toward the substrate by gas passing through holes 18 in air disc 22. Once the reinforcing materials pass the nozzle 1, they are drawn into the resinous mixture and are wetted, thereby forming a combined flow. This combined flow is propelled against the substrate to form the coating.

The thickness of this coating can be varied by altering the rate of motion between the nozzle 1 and the substrate. As the relative motion decreases, the coating thickness increases. Additionally, the conversion efficiency, droplet size, and/or the flow rate of the liquid resin can be adjusted to attain the desired coating density and or strength. Increasing the reinforcing material flow rate decreases the coating density while decreasing the reinforcing material flow increases the coating strength.

It should be noted that the present spray coating apparatus and method can be automated utilizing conventional automation techniques and equipment such as computers, metering devices, pressure control devices, and other conventional equipment.

The present invention will be clarified with reference to the following illustrative example. This example is given to illustrate the process of coating a substrate using the spray coating apparatus of the present invention. It is not, however, meant to limit the generally broad scope of the present invention.

EXAMPLE

The following process has been used to produce a 0.50 thick coating of 2216 epoxy liquid resin, cork, and glass microspheres on a painted substrate.

1. A 5 gallon supply of 2216 liquid resin (Part B) and a 5 gallon supply of curing agent (Part A, amine terminated polymer) were separately heated to 110° F. and pumped at a rate of 225 grams per minute (g/min) (200 milliliters per minute (ml/min)) to the cylinder 12 where they were mixed to form a resinous mixture.
2. The resinous mixture then passed through the orifice 7 in the nozzle 1 and was atomized by 10 atomizing holes 6 having diameters of 0.015 to 0.030 inches and expending air at 25 psig.
3. The atomized resinous mixture was then shaped by 4 shaping holes 8 expending air at a pressure of 15 psig, thereby producing an 8 inch fan pattern. These shaping holes 8 were located at an angle of 20° with the resinous material flow axis.
4. Concurrent with the liquid resin flow, 100 g/min (700 ml/min) of cork and 100 g/min (400 ml/min) of glass microspheres, under 20 psig, were introduced to the cavity 13 through a stainless 3 $ft^3$ stall with a loss in weight metering system and through conduit 16.
5. The cork and glass were then suspended and carried toward the substrate, around the cylinder 12, by air at 90° passing through 8 holes 18 having diameters of 0.080 inches.
6. Upon reaching the end of the cylinder 12, the cork and glass were drawn into the resinous mixture and wetted, thereby forming a combined flow.
7. With the nozzle 1 maintained at a 10 inch standoff distance from the substrate, the combined flow produced a 0.5 inch coating on a vertical substrate after 4 passes.

The coating of the above Example was a uniform, lightweight cork/glass coating with a density range from about 25 $lbs/ft^3$ (pounds per cubic foot) to about 30 $lbs/ft^3$, and having a flatwise tensile adhesion range from about 100 $lbs/in^2$ (pounds per square inch) to about 300 $lbs/in^2$. This coating can be used as a thermal insulation or as an ablative coating for aerospace hardware.

The advantages of the present invention include decreased waste, lower cost, simplified maintenance, simplified system, improved liquid wetting of the reinforcing material, improved sprayability, elimination of pot life issues, and the ability to produce uniform thick coatings with excellent adhesion. On horizontal surfaces, unlimited coating thicknesses can be obtained. On vertical surfaces, coatings up to 1 inch or greater can be obtained with the initial process, while coatings up to about 4 inches or greater can be obtained if the coating is dried after approximately each inch has been applied.

Since the liquid resin is not combined with the reinforcing material within the spray coating apparatus and since the liquid resin is not mixed with additional liquid resins or other conventional components until immediately prior to the nozzle, the amount of liquid resin and/or combined reinforcing material and liquid resin which must be discarded as waste is minimal, and clogging problems are virtually eliminated.

Generally, prior art spray coating processes comprised preparing the coating mixture by mixing the liquid resin with a solvent in a vat to decrease its viscosity, then pumping the mixture through lines to a spray nozzle, and spraying the mixture onto the substrate. Since the entire mixing process occurred early in the process, the entire system required cleaning because the excess mixture in the lines can begin to cure, thereby clogging the system. Additionally, a greater amount of excess mixture was produced, and since the solvent was typically an environmentally hazardous substance, the entire excess mixture was hazardous, thereby increasing disposal costs and harming the environment.

Improved sprayability is also achieved with the present invention by the reduction of the liquid resin's viscosity through the application of heat. Viscosity reduction improves the flowability and therefore the sprayability of the liquid resin without the use of environmentally harmful solvents.

The present invention is an overall improvement over prior art spray coating techniques since it improves sprayability, reduces excess material, and improves flowability by reducing the viscosity of the liquid resin without the production of hazardous waste.

Although this invention has been shown and described with respect to detailed embodiments thereof, it would be understood by those skilled in the art that various changes in form and detail thereof may be made without departing from the spirit and scope of the claimed invention.

We claim:

1. A method for forming a reinforced matrix, comprising the steps of:

a. introducing a liquid to a nozzle having an orifice, and at least one atomizing hole;

b. passing said liquid through said orifice;

c. atomizing said liquid by introducing an atomizing gas to said at least one atomizing hole; and d. moving reinforcing material past said nozzle such that flow of the reinforcing material is substantially parallel to the liquid passing through said orifice, wherein after passing said nozzle, said reinforcing material is drawn into the atomized liquid to form a reinforced matrix.

2. A method for forming a reinforced matrix as in claim 1, further comprising the step of heating said liquid to reduce the viscosity of said liquid to below about 2,000 cps.

3. A method for forming a reinforced matrix as in claim 1, further comprising the step of mixing said liquid with a second liquid prior to exiting said nozzle.

4. A method for forming a reinforced matrix as in claim 3 wherein said second liquid is a liquid resin, a curing agent, a biocide, or a mixture thereof.

5. A method for forming a reinforced matrix as in claim 1, further comprising substantially uniformly distributing said reinforcing material around said nozzle.

6. A method for forming a reinforced matrix as in claim 1, further comprising shaping said liquid by introducing shaping gas to shaping holes on said nozzle.

* * * * *

UNITED STATES PATENT AND TRADEMARK OFFICE

CERTIFICATE OF CORRECTION

PATENT NO. : 5,579,998

DATED : December 3, 1996

INVENTOR(S) : Terry L. Hall et al

It is certified that error appears in the above-identified patent and that said Letters Patent is hereby corrected as shown below:

In column 1 at line 6, change "failed" to --filed--.
In column 5 at line 22, change "closed end of" to --closed end 14b of--.

Signed and Sealed this

Nineteenth Day of August, 1997

*Attest:*

*Attesting Officer*

Bruce Lehman

BRUCE LEHMAN

*Commissioner of Patents and Trademarks*